US005102088A

United States Patent [19]

Ramani

[11] Patent Number: 5,102,088

[45] Date of Patent: Apr. 7, 1992

[54] PORTABLE BOOK HOLDER

[75] Inventor: Raj Ramani, Highland Park, N.J.

[73] Assignee: Five Star Ideas, Inc., Highland Park, N.J.

[21] Appl. No.: 633,041

[22] Filed: Dec. 24, 1990

[51] Int. Cl.[5] ..... A47B 47/00

[52] U.S. Cl. ..... 248/460

[58] Field of Search ..... 248/460, 444.1, 441.1, 248/445, 448, 447.1; 211/195

[56] References Cited

U.S. PATENT DOCUMENTS

| | | | |
|---|---|---|---|
| 2,844,347 | 7/1958 | Henry | 248/460 |
| 3,255,989 | 6/1966 | Risk | 248/460 |
| 4,116,413 | 9/1978 | Andersen | 248/460 X |
| 4,996,404 | 2/1991 | Skerker et al. | 211/195 X |

FOREIGN PATENT DOCUMENTS

| | | | |
|---|---|---|---|
| 10349 | 1/1902 | Norway | 248/460 |

*Primary Examiner*—David L. Talbott
*Attorney, Agent, or Firm*—Robert J. Ferb

[57] ABSTRACT

A portable book holder which is comprised of two interlocking portions which fold into a flat configuration for easy storage and carrying. The portable book holder may include supports to keep the reading material from sliding off the holder. The portable book holder maintains the book or other reading material at a convenient angle tipped up from the horizontal for easy reading and permits the open pages to lay at a wide angle to permit ready visual excess to both left and right hand pages.

7 Claims, 6 Drawing Sheets

PORTABLE BOOK HOLDER

FIELD OF THE INVENTION

This invention deals with portable book holders for supporting books in an open reading position with features of portability and a compact flat configuration when folded.

PRIOR ART

The prior art discloses numerous variations of book holders of different configurations including the following patents:

U.S. Pat. No. 4,655,478, describes a book holder with a flexible web,

U.S. Pat. No. 3,833,197 describes a book holder with a fence confining the pages of the book, U.S. Pat. No. 3,934,806 describes a bi-level book holder on a floor mounted movable stand, U.S. Pat. No. 4,465,255 describes a bedside book holder with a transparent table, U.S. Pat. No. 3,794,284 describes a book support and reading rack which is in the form of a trapezoidal one piece device, U.S. Pat. No. 4,743,135 describes a fixed position catalog and magazine holder to display pre-selected materials, U.S. Pat. No. 4,790,506 describes a support stand for reading material which includes a floor mounted holding device, U.S. Pat. No. 4,801,120 describes a reading apparatus which incorporates a floor mounted holding device.

U.S. Pat. No. 3,677,510 describes a book support for the physically infirm which incorporates a roller type device for restraining the pages from turning.

U.S. Pat. No. 1,021,183 describes a book holder which includes an adjustable shaft mounted holding assembly, U.S. Pat. No. 1,380,755 describes a posting ledger rack which permits various positioning of the ledger book in either in a fully opened position or a posting position.

U.S. Pat. No. 1,862,562 describes a book holder which incorporates a floor mounted adjustable stand.

U.S. Pat. No. 2,648,931 describes a knockdown book holder which is portable in which toes restrain the pages of the book from turning, heels support the toe and back portion into which the book is inserted in each of the two members comprising the holder.

SUMMARY OF THE INVENTION

This invention which is a portable folding book support, that is compact in size, light in weight, readily foldable into a flat configuration, does not interfere with turning of the pages and permits the book to be disposed in a readily readable manner.

Accordingly, it is an object of this invention to provide a portable and collapsible book holder.

It is a further object of the invention to provide a book holder to dispose reading material in a position readily readable by various individuals including far-sighted individuals who can place the reading material at a length beyond the reach of their arms, the elderly or otherwise incapacitated, to position and support reading material without the need to hold it, or for any other person to provide the free use of their hands for other purposes such as performing calculations or other such activities while disposing reading material in a convenient reading position.

It is also an object of this invention to provide a portable book holder which maintains reading material in a convenient plane of vision different from the horizontal plane.

It is also an object of this invention to provide for a portable book holder to be placed on a flat surface such as a desk top, table top or other such surface.

It is also an object of this invention to provide a portable book holder which folds into a flat configuration so that it can be carried along with books, pads on another material in a bookcase or briefcase or other such carrying device without requiring a substantial amount of space or contributing a substantial amount of weight to be carried.

It is a further object of this invention to provide a book holder that permits a reader to readily turn pages without having any fixed restraining devices in the path of the pages. It is also an object of this invention to provide a reading stand which can accommodate reading material of various sizes and various thicknesses without significant limitations.

It is also an object of this invention to provide an integral folding portable book holder which is a single integral assembly which can not be rendered inoperative by misplacing a portion of the assembly.

It is also an object of this invention to provide a portable book holder which provides a means to display information such as reference materials, conversion tables, advertising materials and other such subject matter of interest to the user.

BRIEF DESCRIPTION OF THE DRAWINGS

The invention is further described in the accompanying drawings.

DETAILED DESCRIPTION OF THE INVENTION

Figure 1:
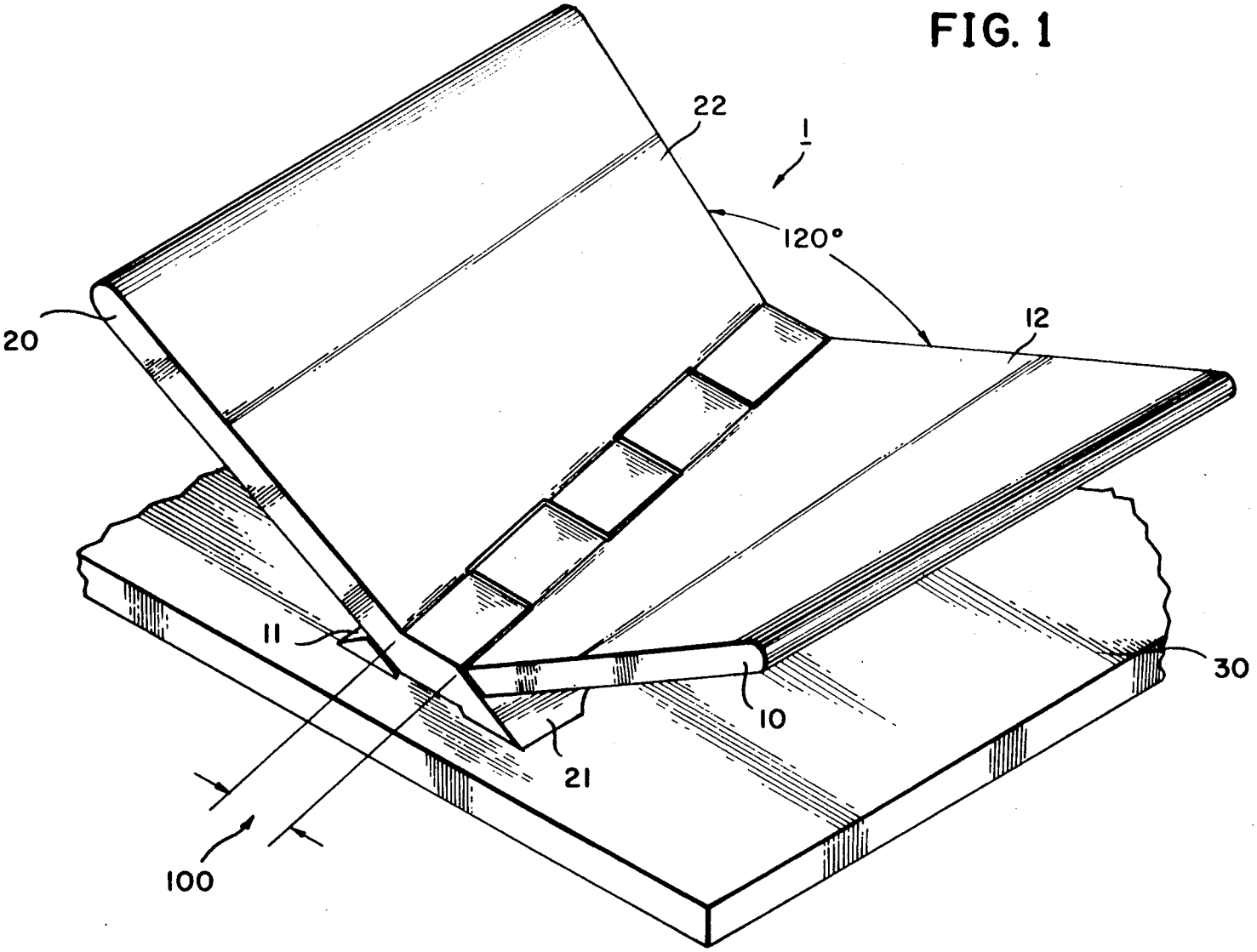
FIG. 1 is an elevation view of the Portable Book Holder from the front.

FIG. 1 illustrates Portable Book Holder 1 which is comprised of right section 10 and left section 20 disposed on a table or desktop. Portable Book Holder 1 is supported by lower edge 11 of right portion 10 and lower edge 21 of left portion 20 disposed on table 30. Face 12 of side 10 and Face 22 of side 20 in the open position are disposed at angle 50 of approximately 120 degrees in the preferred embodiment. However, angle 50 may be as small as 90 degrees or as large as 180 degrees, but is most useful in the range of 110 degrees to 135 degrees.

Figure 2:
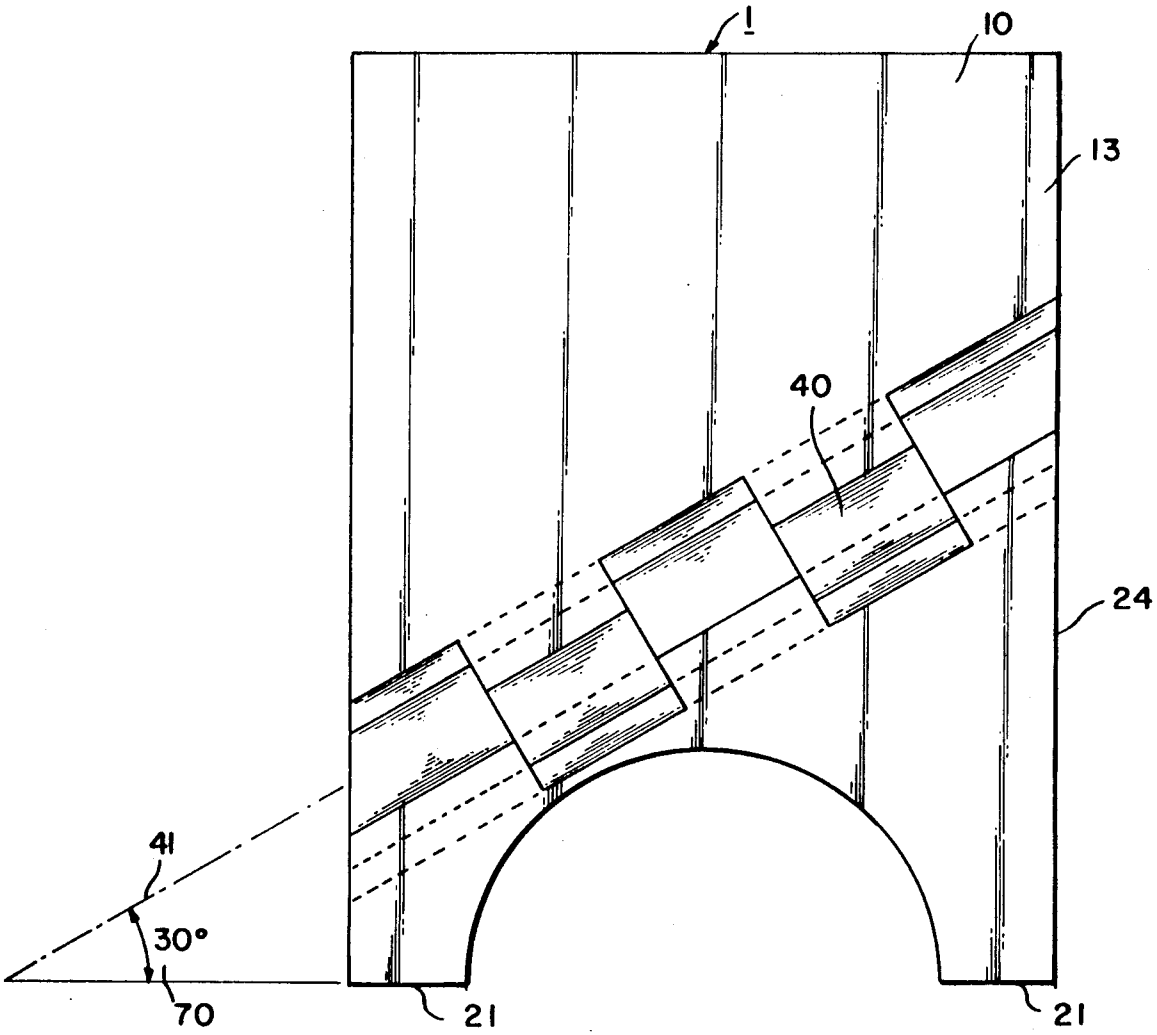
FIG. 2 is a right side view of the book holder in the closed position.

In FIG. 2 Portable Book Holder 1 is viewed from the right side in the closed position. Upper right portion 13 of right portion 10 is disposed above lower left portion 24 of left portion 20 of Portable Book Holder 1. Upper right portion 13 is disposed along folding hinge 40 adjacent to lower left portion 24.

Figure 3:
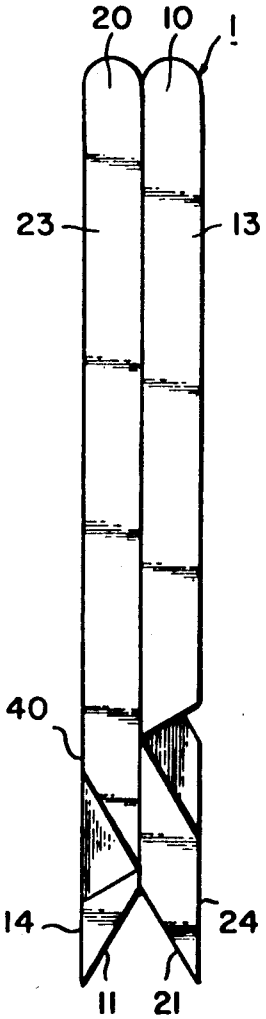
FIG. 3 is a front end view of the book holder in the closed position.

FIG. 3 illustrates a front view of Portable Book Holder 1 illustrating the flat configuration when right portion 10 is folded along folding hinge 40 adjacent to left portion 20. FIG. 3 also illustrates the plainer offset between upper right portion 13 and lower right portion 14 of right portion 10 as well as the plainer offset between upper left portion 23 and lower left portion 24 of left portion 20.

Figure 4A:
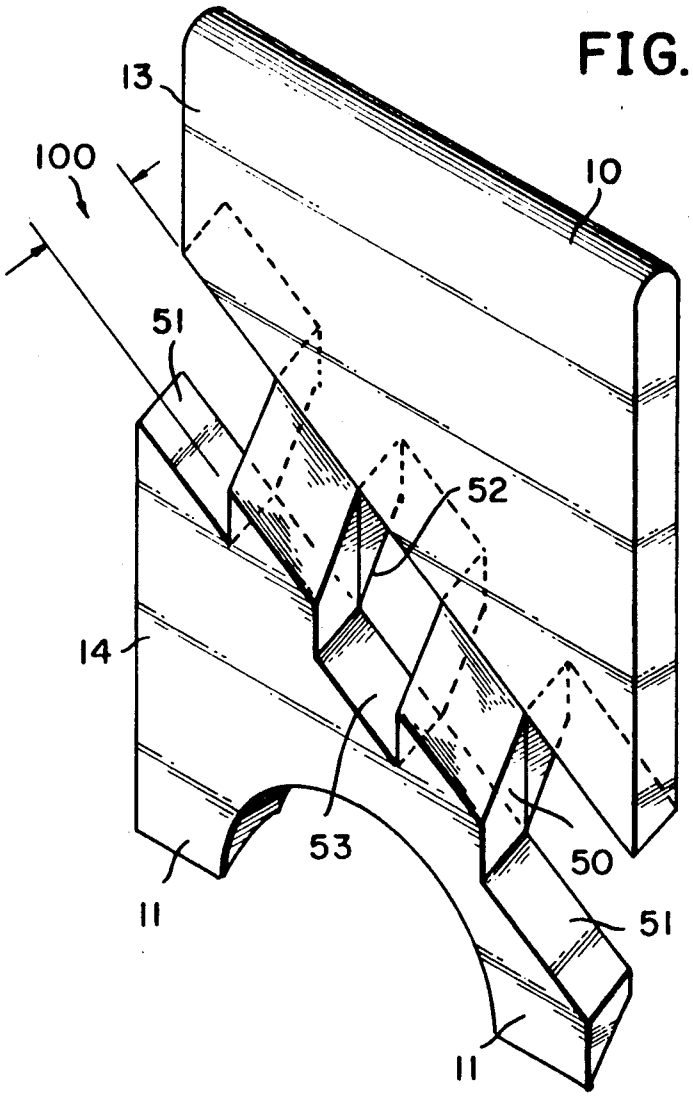
FIG. 4A illustrates the left side portion of the book holder.
Figure 4B:
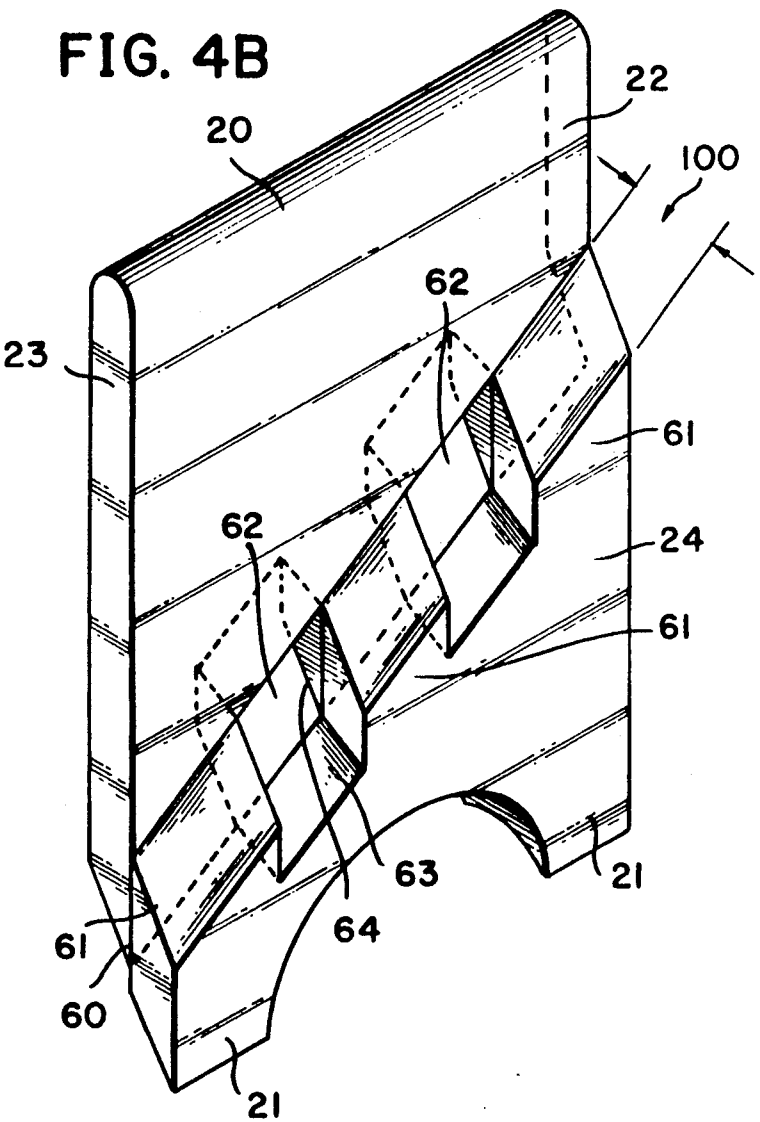
FIG. 4B illustrates the right hand portion of the book holder.

FIG. 4A illustrates interconnections 50 which span the gap between upper right portion 13 and lower right portion 14. In this embodiment interconnections 50 join upper right portion 13 to lower right portion 14 leaving spaces 51 which are equal in width in the preferred embodiment. FIG. 4B illustrates left portion 20 which is comprised of upper left portion 23 and lower left portion 24 which are joined along seam 60. In the preferred embodiment projections 61 extend from lower left portion 24 and are fixedly attached to upper left portion 23 along seam 60. In the preferred embodiment three projections 61 are disposed uniformly along lower left portion 24 to produce two openings 62 when lower left portion 24 is joined to upper left portion 23. Projections 62 are of a width and location such that projections 61 fit into spaces 51 and interconnections 50 fit into openings 62. Portable Book Holder 1 is assembled by inserting projections 61 into spaces 51 on left side 20 and then attaching in a fixed fashion upper left portion 13 to lower left portion 24 along seam 60. Projections 61 in cooperation with spaces 51 and connectors 50 in cooperation with openings 62 after joining of lower left portion 24 to upper left portion 23 form hinge connector 40. This configuration permits right portion 10 and left portion 20 to be rotated from the position as illustrated in FIG. 3 where right portion 10 is disposed parallel to left portion 20, where Portable Book Holder 1 is in a flat configuration, to the position illustrated in FIG. 1 such that lower edge 11 of right portion 10 and lower edge 21 of left portion 20 are disposed in a flat plane and right portion 10 and left portion 20 are disposed relative to each other at angle 5 of approximately 120 degrees in the preferred embodiment. Furthermore, in the preferred embodiment centerline 41 of folding hinge 40 is disposed at angle 70 of approximately 30 degrees from the plane formed by right lower edge 11 and left lower edge 21 as portable book holder 1 rests on table 30. However, angle 70 may be as small as 0 degrees or as large as 60 degrees, but is most useful in the range of 20 degrees to 45 degrees.

As further illustrated in FIG. 4A and 4B, when Portable Book Holder 1 is in the open position as illustrated in FIG. 1, back edge 52 of interconnection 50 rests against lower edge 63 of opening 62 on lower left portion 24. In like manner back portion 64 of projection 61 rests against lower edge 53 of space 51 on lower right portion 14 when portable book holder 1 is in the open position. The length of interconnection 50 and projection 61 determine the width of flat area 100 when portable book holder 1 is in the open position. In the preferred embodiment flat area 100 is approximately two inches wide. However, flat area 100 may be eliminated or be as wide as four inches, but is most useful in the range of one to two and one half inches.

Figure 2A:
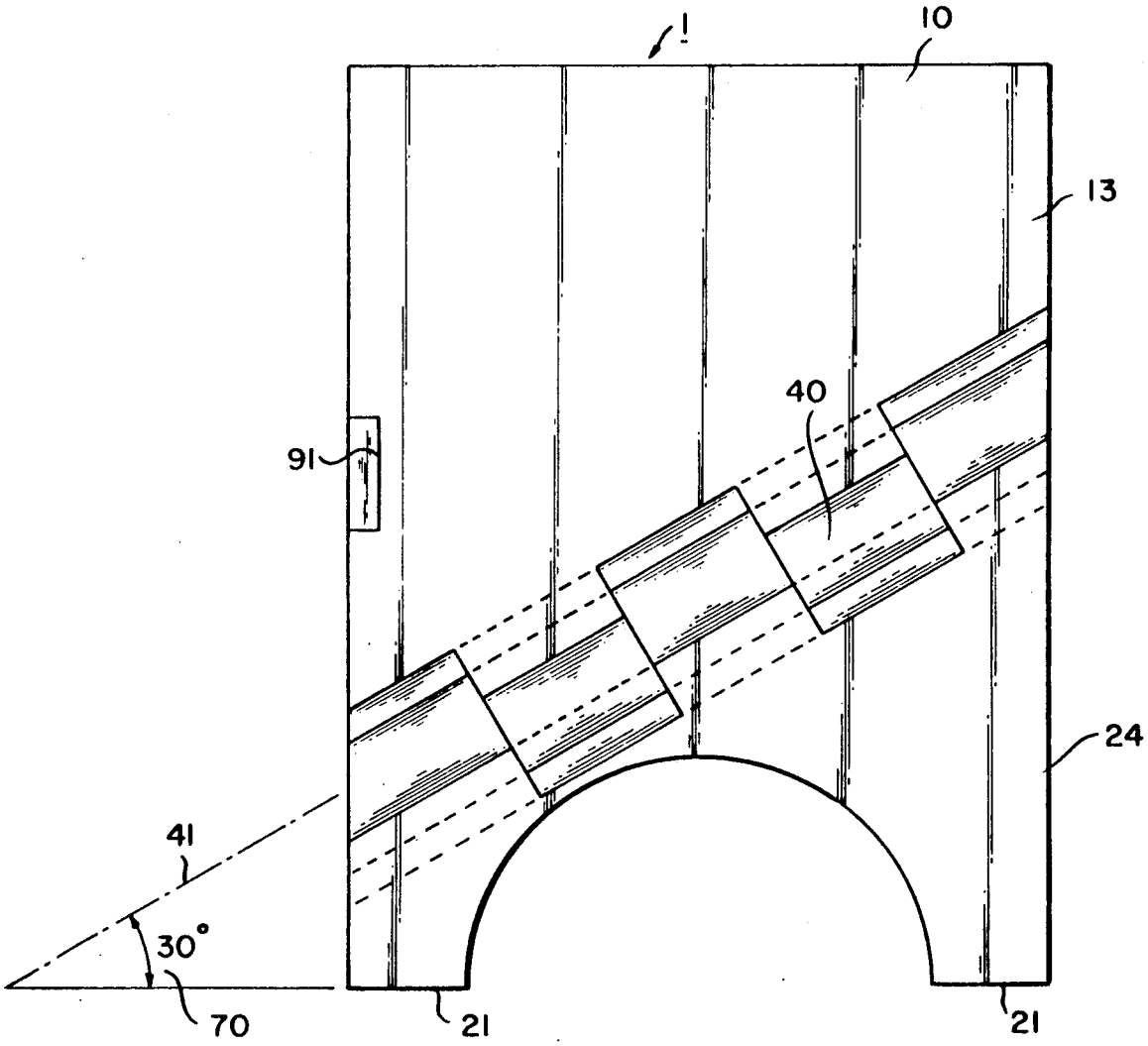
FIG. 2A is a right side view of the book holder illustrating integral book supports.
Figure 3A:
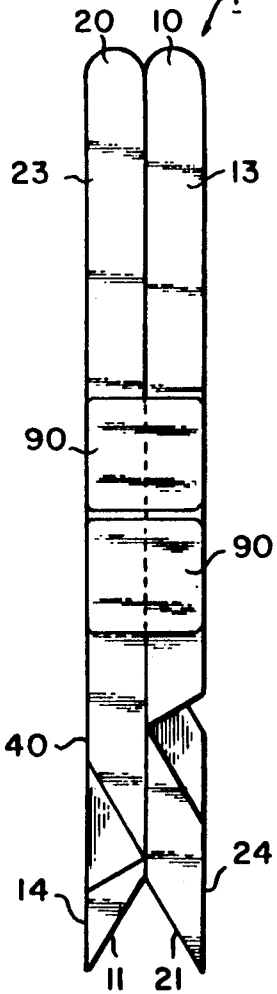
FIG. 3A is a right side view of the book holder illustrating integral book supports.
Figure 7A:
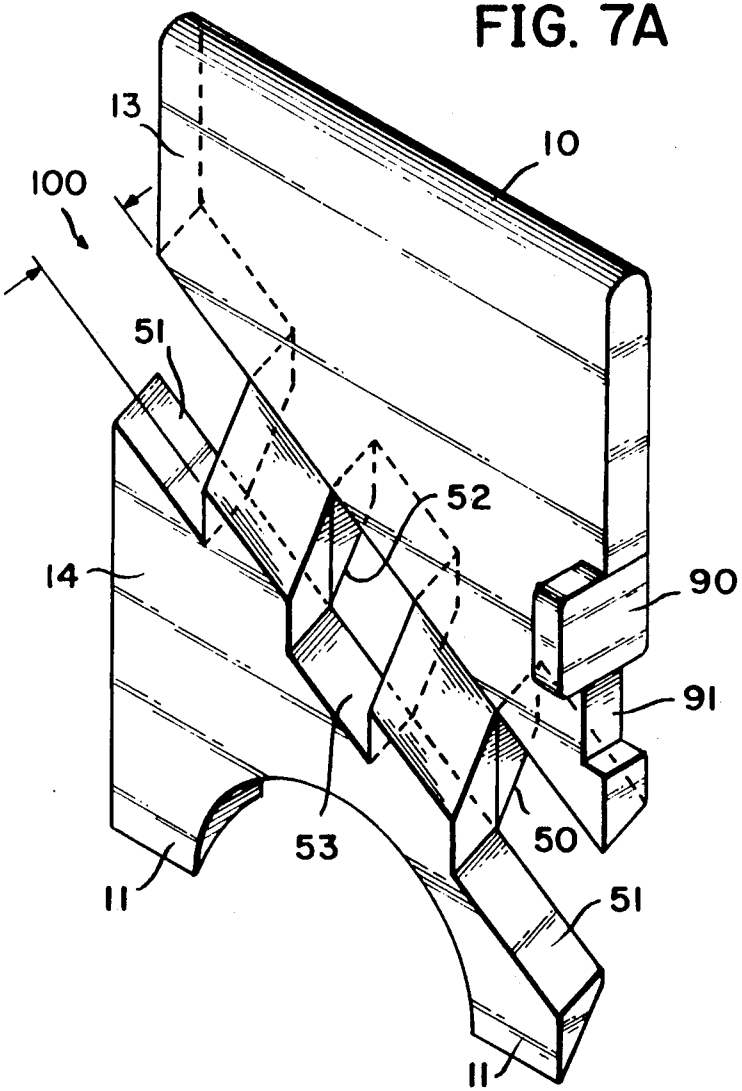
FIG. 7A illustrates the left hand portion of the holder which includes an integral book support.
Figure 7B:
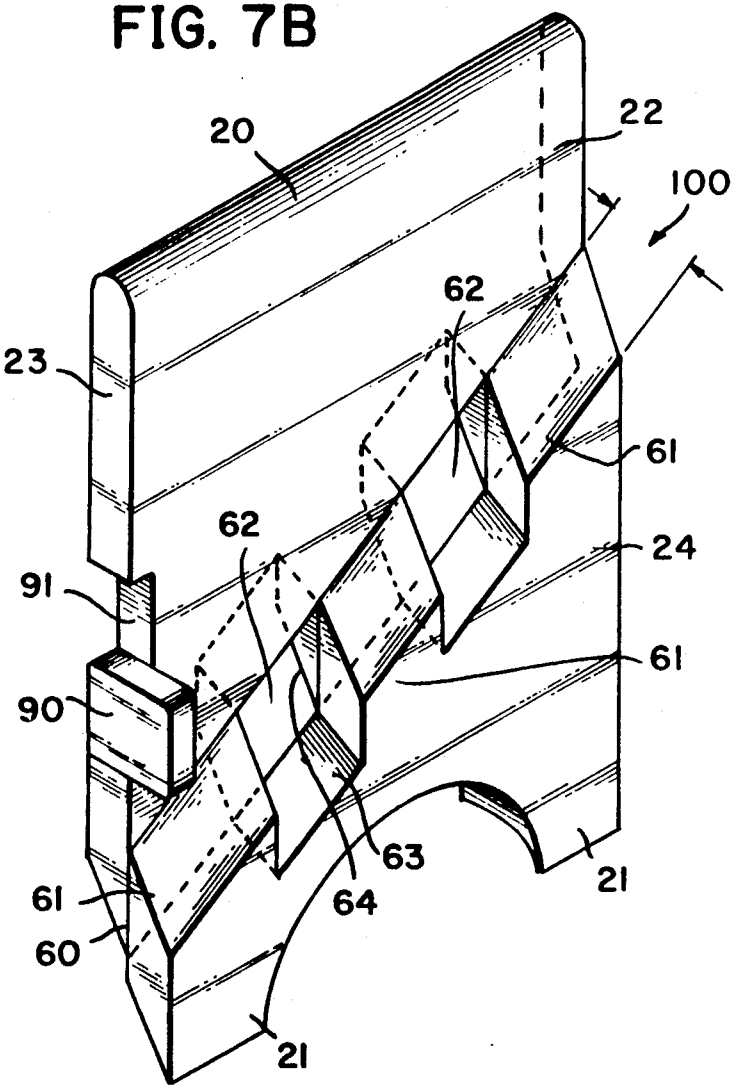
FIG. 7B illustrates the right side of the book holder which includes an integral book support.

An alternative embodiment is pictured in FIG. 3A in which book supports 90 project from left portion 20 and right portion 10 into slots 91 when Portable Book Holder 1 is in the folded position. Book supports 90 and corresponding slots 91 are also illustrated in FIG. 2A. FIGS. 7A and 7B illustrate the location of book supports 90. FIG. 7B illustrates left portion 20 and the disposition of book support slot 91 and book support 90. FIG. 7A of right portion 10 illustrates the disposition of book support slot 91 and book support 90. The relative location of book supports 90 and book support slots 91 are such that they cooperate such that each book support 90 fits into corresponding book support slot 91 when right portion 10 is folded parallel to left portion 20 in the flat position as illustrated in FIG. 3A.

Figure 5B:
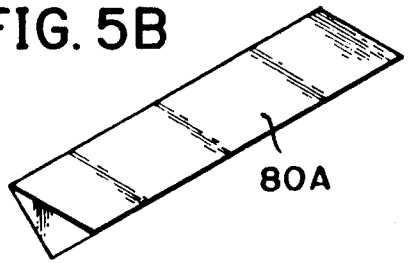
FIG. 5B illustrates an alternative embodiment of a page divider.
Figure 6:
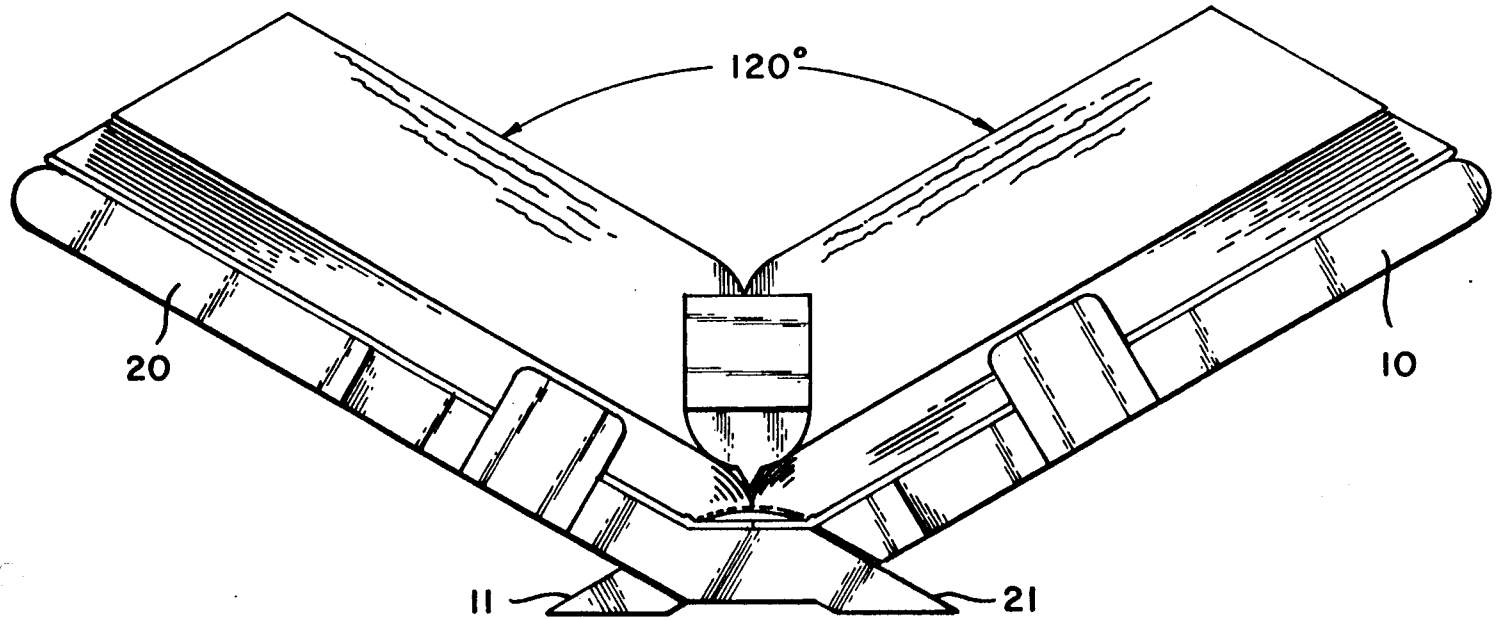
FIG. 6 illustrates the disposition of the page divider within book.
Figure 5A:
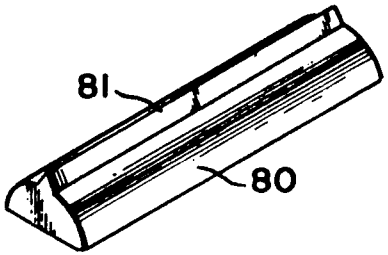
FIG. 5A illustrates a page divider.

FIG. 5A illustrates page divider 80 which is used to hold the pages of a book open when it is disposed on portable book holder 1 to prevent the pages from turning from the page desired by the user. Page divider 80 is preferably made from a soft material with a surface exhibiting some fiction so it tends not to slide and further, in the preferred embodiment incorporates tab 81, as illustrated in FIG. 6, which disposes itself into the crevice between the pages of the book as page divider 80 is inserted to hold the pages of the book from turning. FIG. 5B illustrates page divider 80A which is an alternative embodiment of page divider 80.

The description of the invention disclosed herein is illustrative of the preferred embodiments of the invention and it is intended to illustrate the same. It is understood that alternative embodiments incorporating larger or smaller angles between right and left portions and alternative angles of the folding hinge from the horizontal plane as well as variation of the number and length of interconnections and projections and the method of assembly are within the contemplation of this invention. In addition to disposing material for reading and display it is within the contemplation of this invention to make use thereof for writing, sketching, drawing, editing and other such activities.

I claim:

1. I claim a portable book holder which is comprised of a right portion which is further comprised of an upper right portion containing at least one interconnection which connects said upper right portion to a lower right portion which is parallel to but offset from said upper right portion and which said right portion is rotatably joined with a left portion which is further comprised of an upper left portion and a parallel but offset lower left portion which are joined by at least two projections which cooperates with said interconnection to form a rotatable hinge between said left and right portions to permit said left and right portions to be folded flat against one another or to be opened to a position for the placement of books at an angle suitable of reading in which the angle formed between said right portion and said left portion in the open position is in the range of 110 to 135 degrees and in which the angle formed between the angle between the centerline of said hinge and the surface upon which said portable book holder rests is in the range of 20 to [illegible] degrees.

2. A portable book holder as described in claim 1, which is comprised of at least two interconnections.

3. A portable book holder as described in claim 1, which is said left and right portions incorporate a book support and cooperating slot to support a book placed on said portable book holder and permit said portable book holder to fold flat.

4. A portable book holder as described in claim 3, which is comprised of at least two interconnections.

5. A portable book holder as described in claim 1, in which the flat area formed by said projections and interconnections when said portable book holder is disposed in the open position is one inch to two and one half inches in width.

6. A portable book holder as described in claim 6, in which the flat area formed by said projections and interconnections when said portable book holder in disposed in the open position is one inch to two and one half inches in width.

7. A portable book holder as described in claims 1,2,4,5, 11 or 12 which is further comprised of a cooperating page divider.

* * * * *

UNITED STATES PATENT AND TRADEMARK OFFICE

CERTIFICATE OF CORRECTION

PATENT NO. : 5,102,088

DATED : April 7, 1992

INVENTOR(S) : Ramani, Raj

It is certified that error appears in the above-identified patent and that said Letters Patent is hereby corrected as shown below:

| Column | Line | | |
|---|---|---|---|
| 3 | 51 | change | angle "5" to angle "50" |
| 4 | 66 | change | "'.'" to "45" |
| 5 | 2 | change | "which is" to "in which" |
| 6 | 3 | change | claim "6" to claim "3" |
| 6 | 5 | change | "in" to "is" |
| 6 | 9 | change | "1,2,4,5,11 or 12" change to: "1,2,3,4,5 or 6" |

Signed and Sealed this

Thirtieth Day of November, 1993

Bruce Lehman

*Attest:*

BRUCE LEHMAN

*Attesting Officer*

*Commissioner of Patents and Trademarks*